US008992121B2

(12) United States Patent
Cardis et al.

(10) Patent No.: US 8,992,121 B2
(45) Date of Patent: Mar. 31, 2015

(54) LEAF FOR A MITRE GATE AND MITRE GATE INCLUDING SUCH A LEAF

(75) Inventors: Michel Cardis, Grenoble (FR); Michael Mermoud, Chambery (FR)

(73) Assignee: Alstom Renewable Technology, Grenoble (FR)

( * ) Notice: Subject to any disclaimer, the term of this patent is extended or adjusted under 35 U.S.C. 154(b) by 283 days.

(21) Appl. No.: 13/518,816

(22) PCT Filed: Dec. 24, 2010

(86) PCT No.: PCT/FR2010/052913

§ 371 (c)(1), (2), (4) Date: Oct. 8, 2012

(87) PCT Pub. No.: WO2011/077064

PCT Pub. Date: Jun. 30, 2011

(65) Prior Publication Data

US 2013/0022402 A1 Jan. 24, 2013

(30) Foreign Application Priority Data

Dec. 24, 2009 (FR) ..... 09 59591

(51) Int. Cl.
*E02B 7/40* (2006.01)
*E02B 7/20* (2006.01)

(52) U.S. Cl.
CPC .... *E02B 7/20* (2013.01); *E02B 7/40* (2013.01)
USPC ..... 405/99

(58) Field of Classification Search
CPC ..... E02B 7/40; E02B 7/44
USPC ..... 405/87, 99
See application file for complete search history.

(56) References Cited

U.S. PATENT DOCUMENTS 983,937 A * 2/1911 Schildhauer ..... 405/99
1,642,253 A * 9/1927 Lee et al. ..... 405/99

(Continued)

FOREIGN PATENT DOCUMENTS

CN 1477270 A 2/2004
FR 670 961 A 12/1929

(Continued)

OTHER PUBLICATIONS

International Search Report issued on Apr. 11, 2011 for International Application No. PCT/FR2010/052913.

(Continued)

*Primary Examiner* — Frederick L Lagman
(74) *Attorney, Agent, or Firm* — Buchanan Ingersoll & Rooney PC

(57) ABSTRACT

A leaf for a mitre gate is provided. The leaf for a mitre gate may include: a skin plate intended for withstanding a pressure exerted by a liquid; and at least two uprights respectively located on either side of the skin plate, the uprights being secured to the skin plate. The skin plate is in the overall shape of a cylinder portion, the longitudinal axis of the cylinder being essentially parallel to the uprights. Each upright extends overall according to a generatrix of the cylinder. Each upright includes at least one bearing element, arranged to project relative to the skin plate and each bearing element includes a bearing surface, for supporting the bearing element against a lock wall or another leaf of the mitre gate. The bearing surface of each bearing element is aligned with a plane that is tangential to the skin plate.

16 Claims, 6 Drawing Sheets

(56) References Cited

U.S. PATENT DOCUMENTS

| | | | | |
|---|---|---|---|---|
| 2,040,721 | A | 5/1936 | Zimmermann | |
| 7,435,035 | B2 * | 10/2008 | Cullen | 405/99 |

FOREIGN PATENT DOCUMENTS

| | | | | |
|---|---|---|---|---|
| FR | 1 251 332 | A | 1/1961 | |
| FR | 1 505 578 | A | 12/1967 | |
| GB | 143 352 | A | 5/1920 | |
| JP | 06108446 | A * | 4/1994 | E02B 7/54 |
| SU | 1247454 | A1 | 7/1986 | |

OTHER PUBLICATIONS

Office Action and Search Report (First Office Action) issued on Dec. 25, 2013, by the State Intellectual Property Office, P.R. China, in corresponding Chinese Patent Application No. 201080064354.2, and an English Translation of the Office Action. (20 pages).

* cited by examiner

LEAF FOR A MITRE GATE AND MITRE GATE INCLUDING SUCH A LEAF

CROSS REFERENCE TO RELATED APPLICATIONS

This application is a U.S. National Phase of International Application No. PCT/FR2010/052913, filed Dec. 24, 2010, designating the U.S., and published in French as WO 2010/077064 on Jun. 30, 2011 which claims the benefit of French Patent Application No. 09 59591 filed Dec. 24, 2009.

FIELD OF THE INVENTION

The present invention relates to a leaf for a mitre gate. The present invention also relates to a mitre gate having two leaves according to the invention. Such a mitre gate can be used as a lock gate in a stream of water. "Mitre gate" refers to a structure capable of retaining an open-surfaced liquid. When it is in use, a mitre gate separates a downstream pool from an upstream pool in which the liquid to be retained is located. This liquid subjects the mitre gate to a distributed pressure that varies as a function of time and of the distance from the bottom of the gate. A mitre gate therefore works in fatigue because it undergoes cyclic stresses.

BACKGROUND OF THE INVENTION

Each leaf of a mitre gate has a side for hinging with the lock wall and a side where the junction is done with the other leaf of the mitre gate in the middle of the stream of water. A leaf for a mitre gate of the prior art comprises a generally flat skin plate and two uprights respectively located on the hinge side and the junction side of the skin plate. The skin plate is intended to bear pressure exerted by the liquid situated upstream of the mitre gate, which causes two forms of mechanical stress. The lateral ends of the leaf, the hinge side and the junction side, transmit compression forces. Between these two lateral ends, the leaf works in flexion and compression, the flexion work being predominant in the central part of the leaf. Between these two lateral ends, the skin plate works in flexion. The structure of the leaf consists of horizontal beams and vertical and horizontal stiffeners, which are made up of thin plates secured to one another.

However, in a leaf for a mitre gate of the prior art, the compression forces to which the skin plate is subjected are transmitted from one end of the leaf to the other along lines of force that alternatingly pass through said horizontal plates and vertical plates. This alternation causes relatively high stress concentrations between these components, in particular the horizontal beams and the two uprights on the one hand, and the vertical stiffeners on the other hand. However, such stress concentrations decrease the fatigue life, and therefore the useful life, of the leaf.

SUMMARY OF THE INVENTION

The present invention aims in particular to resolve these drawbacks by proposing a leaf whereof the structures causes relatively low stress concentrations.

To that end, the invention relates to a leaf for a mitre gate, the leaf having:

- a skin plate intended for withstanding a pressure exerted by a liquid, and
- at least two uprights respectively located on either side of the skin plate, the uprights being secured to the skin plate.

The skin plate is in the overall shape of a cylinder portion, the longitudinal axis of the cylinder being essentially parallel to the uprights. Each upright extends overall according to a generatrix of the cylinder. Each upright includes at least one bearing element, arranged to project relative to the skin plate, and each bearing element includes a bearing surface, for supporting the bearing element against a lock wall or against another leaf of the mitre gate. The bearing surface of each bearing element is aligned with a plane that is tangential to the skin plate.

In a leaf according to the invention, the cylindrical shape of the skin plate makes it possible to distribute the forces on each side of the leaf. Furthermore, the position of the uprights in the extension of the skin plate therefore allows the two uprights to directly react the compression forces transmitted by the skin plate, which prevents generating stress concentrations. Furthermore, since the bearing surface of each bearing element is aligned with a plane that is tangential to the skin plate, the compression forces are transmitted to the skin plate optimally, which favors the mechanical strength of the leaf.

According to other advantageous, but optional features of the invention, considered alone or according to any technically allowable combination:

- the bearing surface of at least one bearing element is perpendicular to a middle plane that is parallel to the plane tangential to the skin plate and that extends a middle fiber of the skin plate, on the bearing element side;
- the bearing surface is centered on the middle plane;
- the bearing surface of at least one bearing element is planar;
- the bearing surface of at least one bearing element is in the shape of a cylinder portion whereof the longitudinal axis is parallel to the longitudinal axis of the cylinder that defines the shape of the skin plate;
- each bearing element is made up of a profile;
- the cylinder has an elliptical base;
- the cylinder has a circular base;
- the cylinder has a parabolic base;
- a first ratio that has:
  - as numerator, the curve radius of the cylinder, and
  - as denominator, the width of the skin plate, measured between the two uprights, is between 0.6 and 13;
- the leaf also includes thin, flat cores, each core having, in a plane transverse to the skin plate, a curve coinciding with the skin plate, each core widening toward the middle thereof and narrowing toward its ends, each core being secured to the skin plate;
- each core is pierced with at least one recess and in that the leaf includes at least one generally rectilinear stiffener extending through the recesses respectively belonging to several cores;
- at least one stiffener is tubular;
- the or each stiffener is fastened to several cores using welds made in a plane perpendicular to an axis of the cylinder;
- the leaf also includes means for fastening a member for actuating the leaf, the fastening means being connected to one end of a stiffener.

Furthermore, the present invention relates to a mitre gate having two leaves as previously described. A second ratio that has:

- as numerator: the width of the mitre gate, measured between the two uprights that are the furthest apart, and
- as denominator: the curve radius of the cylinder is between 0.6 and 1.8.

BRIEF DESCRIPTION OF DRAWINGS

The invention will be well understood, and the advantages thereof will appear, in light of the following description, provided solely as a non-limiting example and done in reference to the appended drawings, in which.

DETAILED DESCRIPTION OF THE EMBODIMENTS

Figure 1:
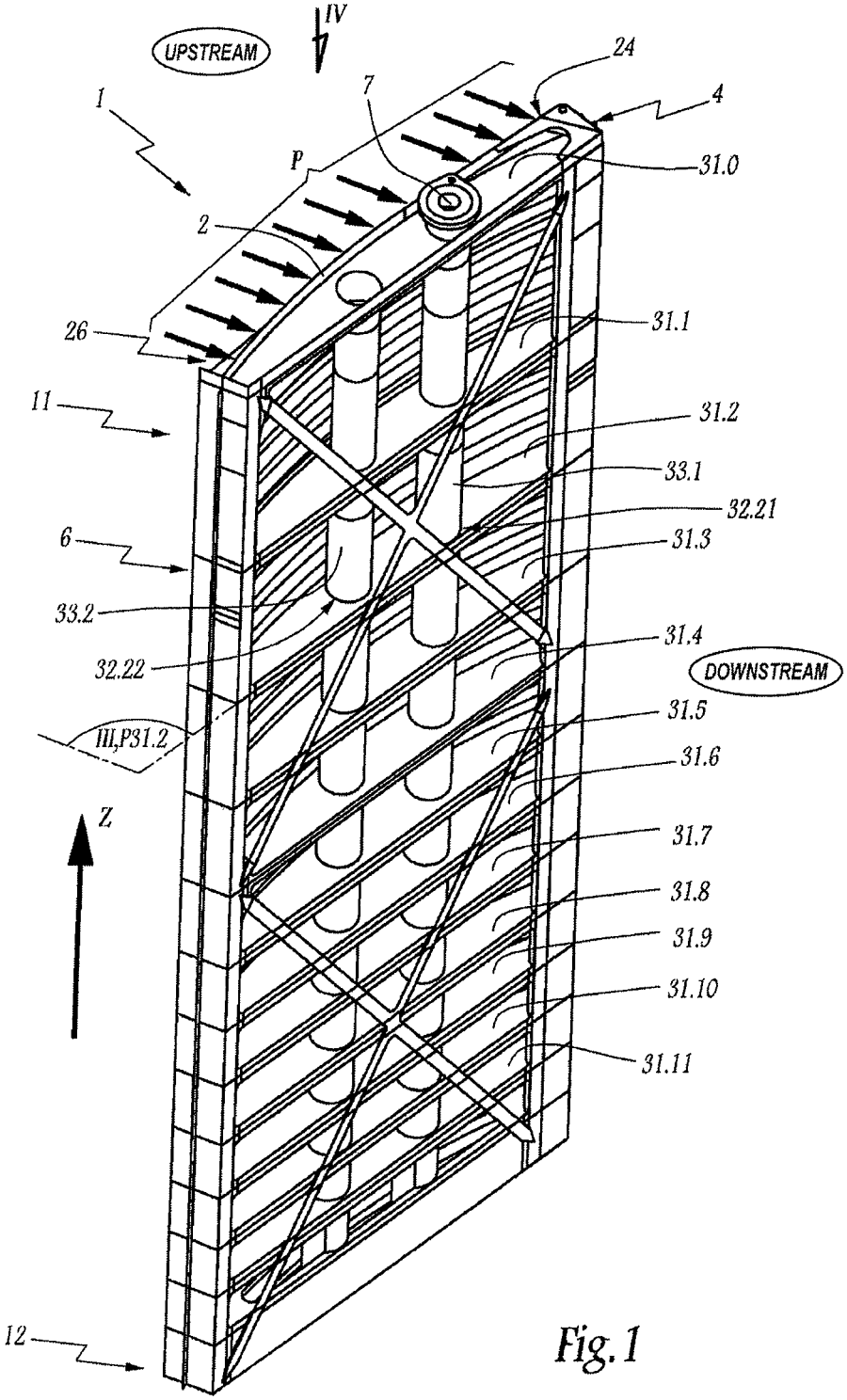
FIG. 1 is a perspective view, with a partial tear-away and from the downstream direction, of a leaf according to the invention.
Figure 2:
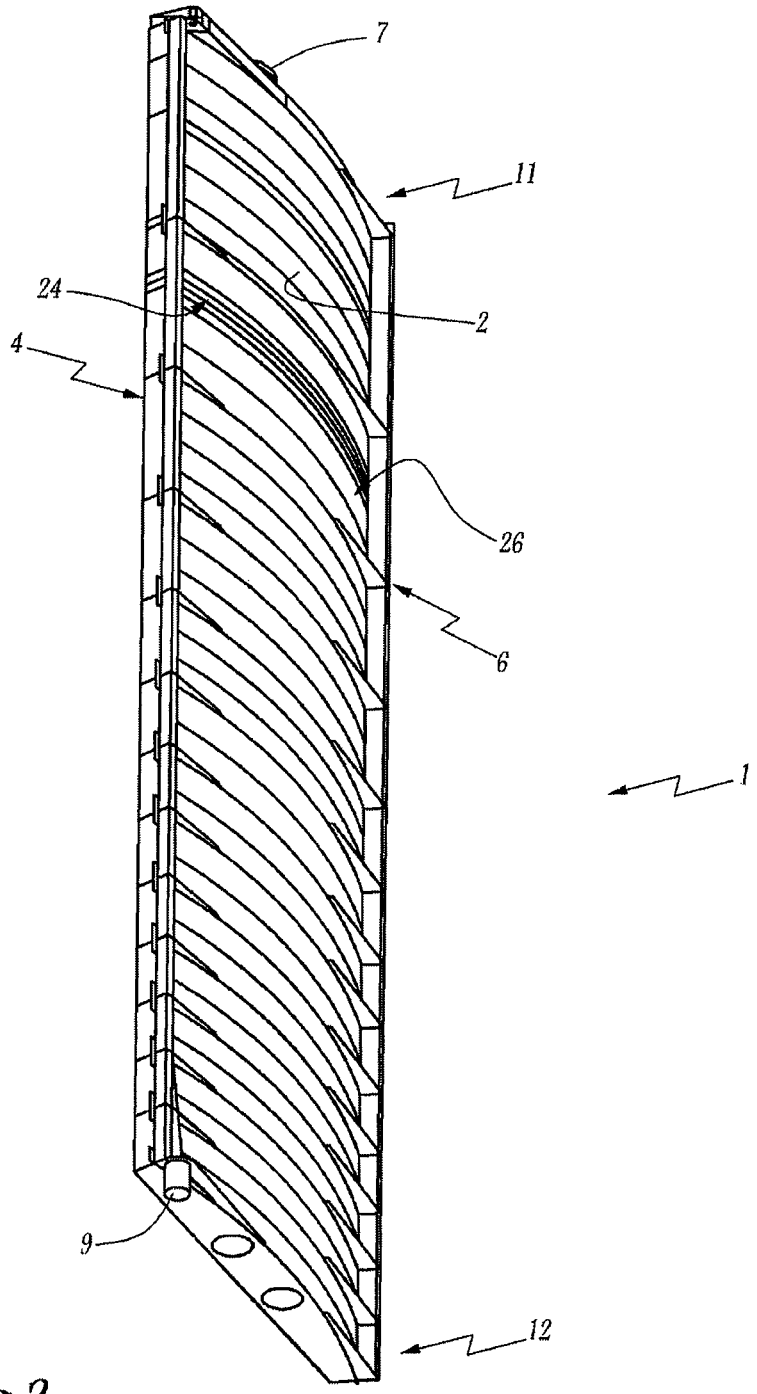
FIG. 2 is a perspective view, from the upstream direction, of the leaf of FIG. 1.

FIG. 1 illustrates a leaf 1 that has a skin plate 2 and two uprights 4 and 6. The skin plate 2 extends over nearly all of the upstream surface of the leaf 1. The outer surface of the skin plate 2, oriented toward the back of FIG. 1, is intended to be turned toward an upstream pool.

Figure 3:
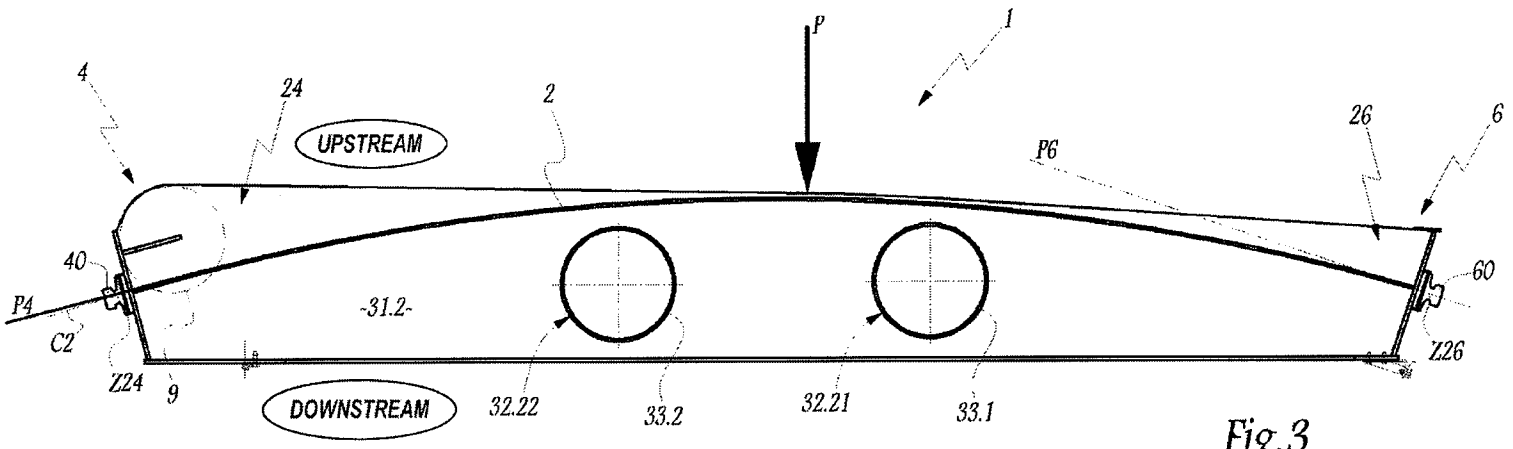
FIG. 3 is a cross-sectional view, along plane III of FIG. 1, of the leaf of FIG. 1.

When the leaf 1 is mounted in a mitre gate that is in use, the retained water subjects the leaf 1 to a pressure P distributed over the skin plate 2. In FIG. 1, the pressure P is shown in the form of a vector field, while FIGS. 3 and 5 illustrate the result of the pressure P.

In this application, the terms "upstream" and "downstream" are preferably used in reference to the general flow direction of the water when the mitre gate is in the open position.

The skin plate 2 has a central region and two lateral or side regions 24 and 26. The uprights 4 and 6 are respectively situated on either side 24 and 26 of the skin plate 2. The uprights 4 and 6 extend parallel to a direction Z that is substantially vertical when the leaf is in the in-use position, as illustrated in FIG. 5. Each upright 4 or 6 extends over the entire height of the leaf 1 in direction Z.

Figure 4:
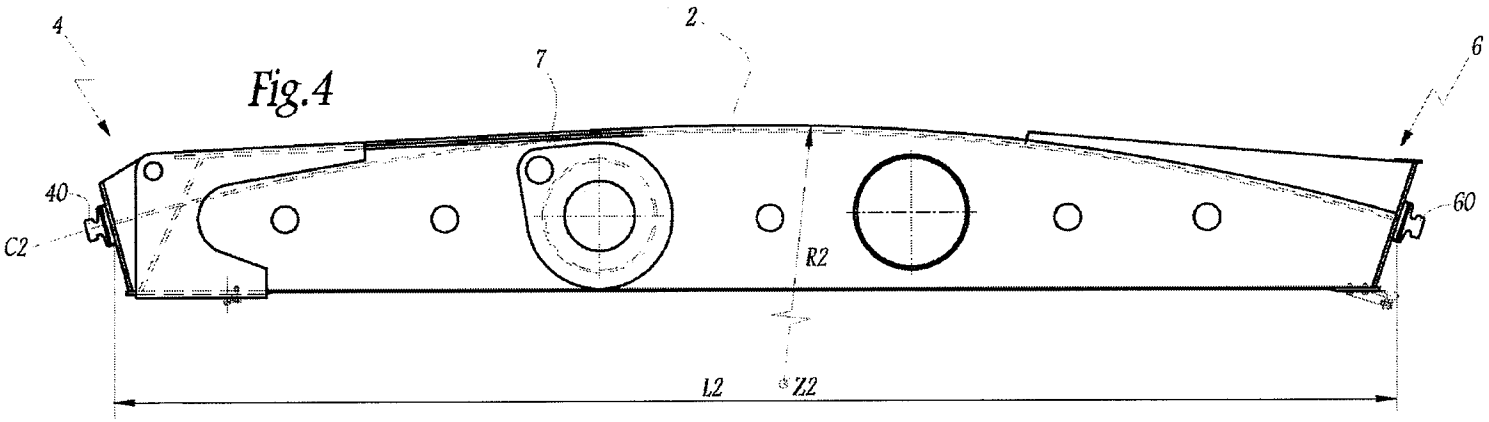
FIG. 4 is a top view, along arrow IV of FIG. 1, of the leaf of FIG. 1.
Figure 5:
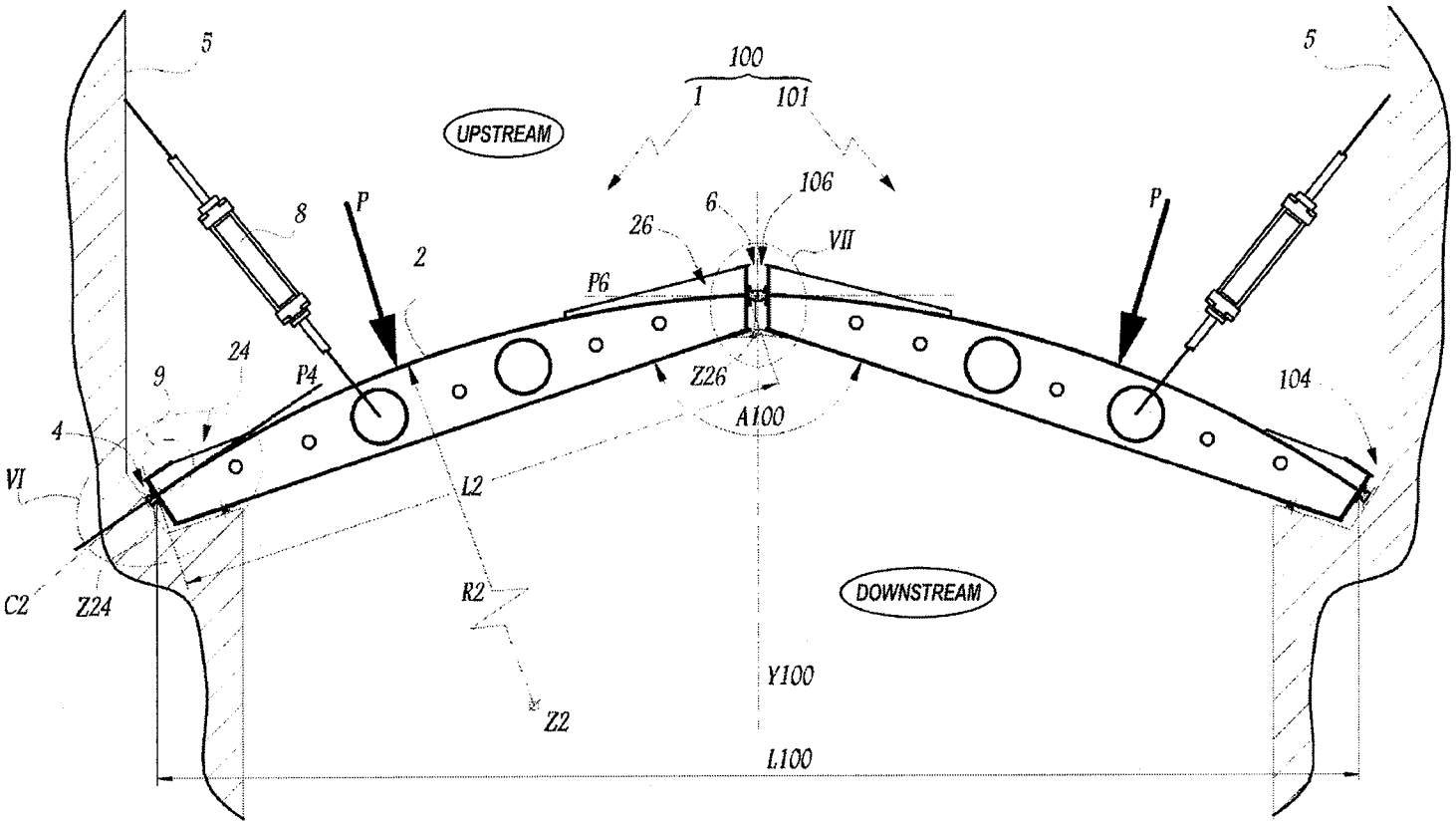
FIG. 5 is a horizontal cross-sectional view of a mitre gate according to the invention and including the leaf of FIGS. 1 to 4.
Figure 6:
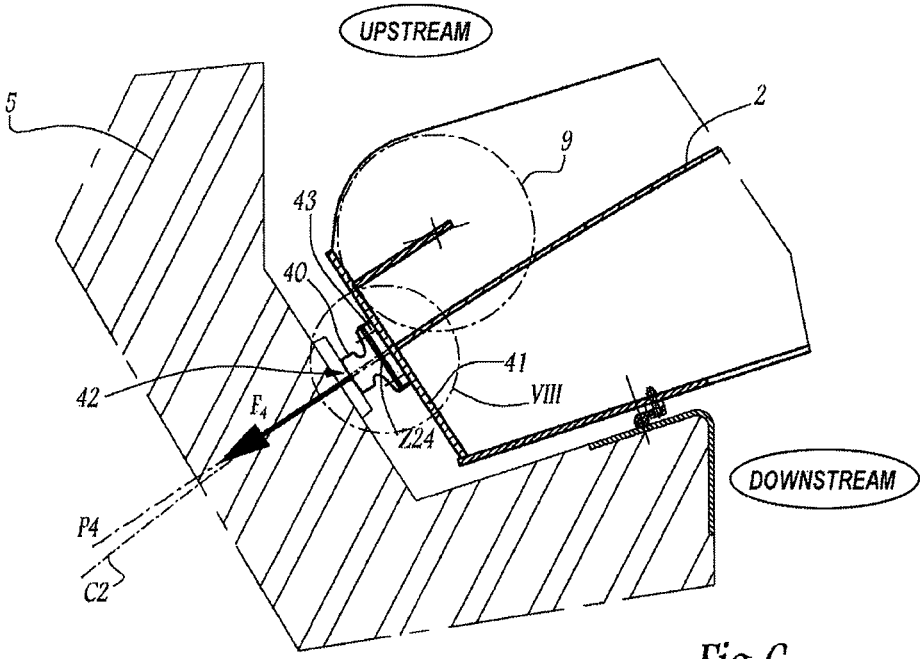
FIG. 6 is an enlarged view of detail VI of FIG. 5.
Figure 7:
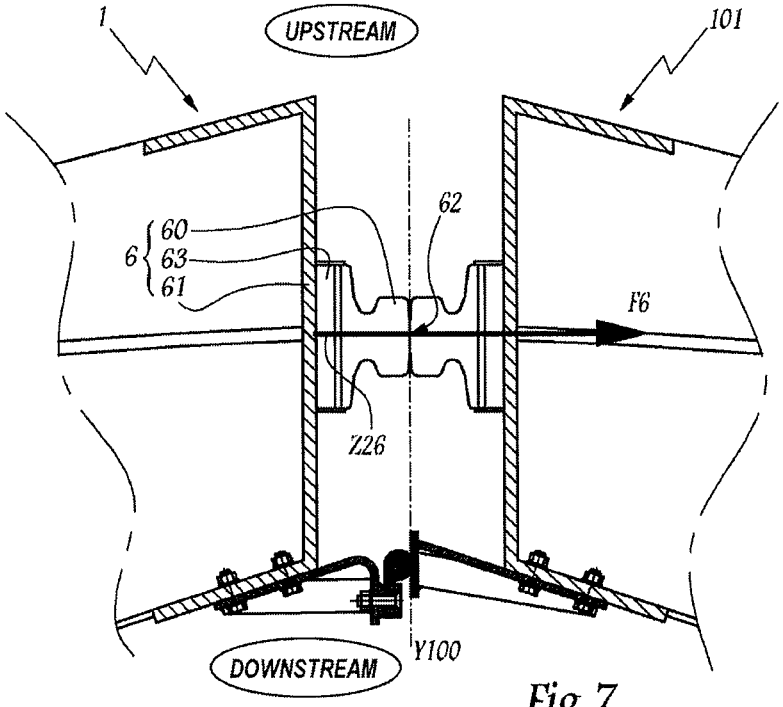
FIG. 7 is an enlarged view of detail VII of FIG. 5.

As shown in FIGS. 1 to 5, the skin plate 2 is generally in the shape of a cylinder portion C2. As shown more particularly in FIGS. 4 and 5, the cylinder C2 constitutes the cylindrical enclosure in which the skin plate 2 fits. The longitudinal axis Z2 of the cylinder C2 is essentially parallel to the uprights 4 and 6. In other words, the axis Z2 is vertical overall when the leaf 1 is in the in-use position, as illustrated in FIG. 5.

Figure 8:
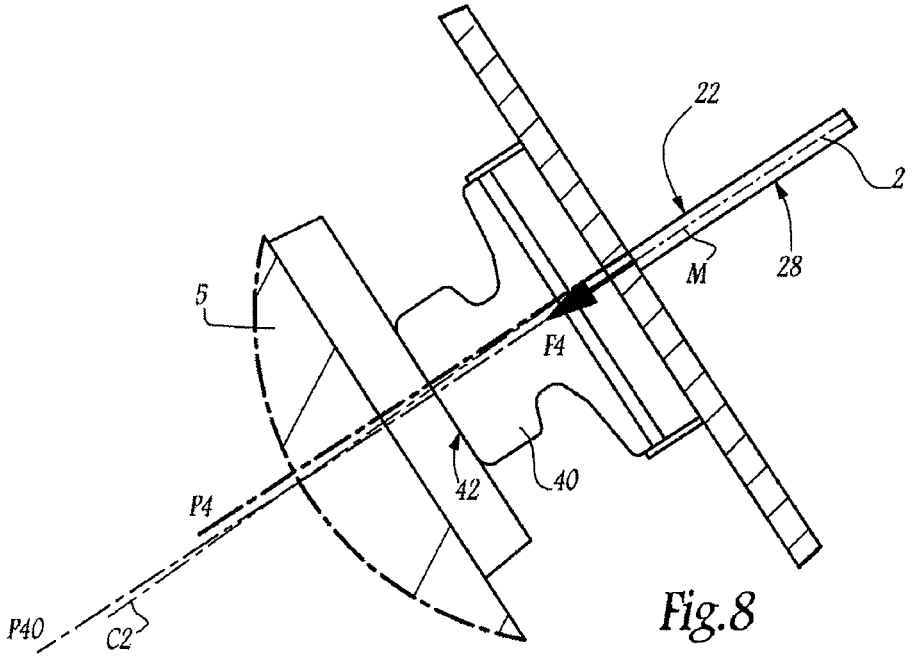
FIG. 8 is an enlarged view of detail VIII of FIG. 6.

As shown more particularly in FIG. 8, the skin plate 2 is delimited by an upstream surface 22 and a downstream surface 28. During use, the upstream 22 and downstream 28 surfaces are respectively intended to be turned toward the upstream and downstream pool side. The cylinder portion C2 that defines the shape of the skin plate 2 coincides with the upstream surface 22 of the skin plate 2.

In the case at hand, the cylinder C2 has a circular base with curve radius R2. In other words, the cylinder C2 is a cylinder of revolution around the single axis Z2 and with radius R2. The cylinder C2 has a relatively large curve radius R2 in relation to a width L2 of the skin plate.

In the example of FIGS. 1 to 7, the curve radius R2 is equal to approximately 13.1 m. The width L2 is equal to approximately 7.5 m. More specifically, a first ratio has:

as numerator: the curve radius R2 of the cylinder C2, and as denominator: the width L2 of the skin plate 2, measured between the uprights 4 and 6 in a plane perpendicular to the axis Z2, such as the plane of FIG. 4 or 5. This first ratio is equal to approximately 1.7.

By design, the curve radius R2 can be between 2 m and 40 m, while the width L2 can be between 3 m and 19 m. The first ratio can be between 0.6 and 13. In other words, the curve radius of the cylinder varies in particular with the width of the leaf, which is equal to the width L2. A first ratio makes it possible to produce a skin plate 2 optimally distributing the compression forces and the flexion forces resulting from the pressure P.

Each upright 4 or 6 extends generally along a respective generatrix Z24 or Z26 of the cylinder C2. In other words, the upright 4 extends generally along the generatrix Z24 and the upright 6 extends generally along the generatrix Z26. The uprights 4 and 6 are therefore parallel to one another. In other words, each post 4 or 6 fits on the cylinder C2 in the extension of the skin plate 2. The uprights 4 and 6 are thereby respectively adjacent to the sides 24 and 26.

The uprights 4 and 6 are connected to the skin plate 2. In this way, the uprights 4 and 6 can react the compression forces transmitted by the skin plate 2. These compression forces are symbolized by arrows F4 and F6, respectively, in FIGS. 6 and 7. The connection between the uprights 4 and 6 and the skin plate 2 can be made using welds or other equivalent securing means.

In a plane perpendicular to the axis Z2, such as the plane of FIG. 3, 4, 5, 6 or 8, the forces F4 and F6 have a component that is supported by a direction that is locally substantially tangential to the skin plate 2 respectively on each side 24 or 26. Such a component of the forces F4 or F6 therefore extends substantially in a respective plane P4 or P6 that is tangential to the upstream surface 22 of the skin plate 2 or the cylinder C2, at each respective side 24 or 26. The planes P4 and P6 are visible in FIGS. 3 and 5.

More specifically, and as shown in FIG. 8, the force F4 extends in a middle plane P40 that extends, on the side 24, a middle fiber M of the skin plate 2, situated equidistant from the upstream surface 22 and the downstream surface 28 of the skin plate 2. Given the imprecisions introduced in practice, the force F4 does not extend exactly in the middle plane P40, but extends substantially in the middle plane P40. Similarly, the force F6 extends substantially in a middle plane P60, not shown, that extends the middle fiber M of the side 26.

Each upright 4 or 6 includes a respective bearing element 40 or 60 that is arranged projecting from the skin sheet 2 so as to transmit the respective forces F4 or F6. The bearing element 40 bears against an oblique surface of a lock wall 5, in particular when the leaf 1 is in the closed position, as illustrated in FIGS. 5, 6, 7 and 8.

The upright 4 also includes a flat beam 41, as well as a crossbeam 43. The flat beam 41, the crossbeam 43 and the bearing element 40 extend over the majority of the height of the leaf 1 in direction Z. The bearing element 40 here is formed by a profile in the form of a rectilinear rail. On the side of the skin plate 2, the bearing element 40 has a base that is fastened on the crossbeam 43. The crossbeam 43 is in turn fastened on the flat beam 41. The assembly formed by the flat beam 41, the crossbeam 43 and the bearing element 40 is approximately symmetrical relative to the plane P4. More specifically, the bearing element 40 is symmetrical relative to the middle plane P40.

As a result, the bearing element 40 is centered on the middle plane P40; in other words, the bearing element extends at least partially along the middle plane P40. As a result, the bearing element 40 is locally tangential to the skin plate 2, at the side 24 of the skin plate 2.

The flat beam 41 is secured to the structure of the leaf 1, as described hereinafter.

On the side opposite the skin plate 2, the bearing element 40 has a flat bearing surface 42, provided for bearing of the leaf 1 against the lock wall 5. The bearing surface 42 is locally perpendicular to the curve defining a base of the cylinder C2 in a plane perpendicular to the axis Z2. Furthermore, the bearing surface 42 is perpendicular to the middle plane P40 and is centered on the middle plane P40. Furthermore, the bearing surface 42 is generally aligned with the plane P4, on the side 24. In other words, the bearing surface 42 is located aligned with the plane P4 and is intersected by the plane P4, since it is perpendicular to the plane P4. Inasmuch as the upright 4 extends generally along and around the generatrix Z24, the forces F4 are transmitted directly from the skin plate 2 to the lock wall 5, without causing significant stress concentrations.

As shown in FIGS. 1 to 4, the leaf 1 also includes several cores 31.0, 31.1, 31.2, 31.3, 31.4, 31.5, 31.6, 31.7, 31.8, 31.9, 31.10 and 31.11 that are thin and flat. Each core 31.0 to 31.11 has, in a plane transverse to the skin plate such as the plane P31.2 or III in FIG. 1, a curve coinciding with the skin plate 2. In other words, each core 31.11 has a cylindrical curve on the upstream side. Each core 31.0 to 31.11 widens toward the middle thereof and narrows toward its ends, i.e. toward the sides 24 and 26 of the skin plate.

Furthermore, each core 31.0 to 31.11 is pierced with two recesses in the form of circular through holes. Thus, the core 31.2 is pierced with two recesses 32.21 and 32.22 that are situated in the central region of the core 31.2 at approximately symmetrical locations relative to the middle plane of the leaf 1.

Furthermore, the leaf 1 includes two stiffeners 33.1 and 33.2 that are generally rectilinear and that extend through the recesses 32.21, 32.22 and equivalent, respectively belonging to several cores 31.0 to 31.11. In the case at hand, each stiffener 32.21 and 32.22 is tubular. Such a shape of the stiffeners 32.21 and 32.22 makes it possible to limit the stress concentrations.

Each core 31.0 to 31.11 is secured to the skin plate 2, for example using welds. Each stiffener 32.21 or 32.22 is fastened to several cores 31.0 to 31.11 using welds that are made in a plane perpendicular to the axis Z2, such as plate P31.2 in FIG. 1. As a result, the welds securing the cores 31.0 to 31.11 to the stiffeners 32.21 and 32.22 are in the form of circles that extend in a horizontal plane when the leaf 1 is in the in-use position.

Such an arrangement of the welds makes it possible to limit the stress concentrations at the interfaces between the cores and the stiffeners, inasmuch as the compression forces and the flexion forces to which the leaf 1 is subjected are essentially transmitted along horizontal planes, so long as the compression forces and the flexion forces are essentially transmitted by the skin plate 2.

The upright 6 also includes a flat beam 61, as well as a crossbeam 63. The flat beam 61, the crossbeam 63, and the bearing element 60 extend over the majority of the height of the leaf 1 in direction Z. The bearing element 60 here is made up of a profile in the form of a rectilinear rail. On the side of the skin plate 2, the bearing element 60 has a base that is fastened on the crossbeam 63. The crossbeam 63 is in turn fastened on the flat beam 61. The assembly formed by the flat beam 61, the crossbeam 63 and bearing element 60 is approximately symmetrical relative to the plane P6. More specifically, the bearing element 60 is symmetrical relative to the middle plane P60.

As a result, the bearing element 60 is centered on the middle plane P60, in other words the bearing element is at least partially aligned along the middle plane P60. As a result, the bearing element 60 is locally tangential to the skin plate 2, at the side 26 of the skin plate 2.

The flat beam 61 is secured to the structure of the leaf 1, as described below.

On the side opposite the skin plate 2, the bearing element 60 has a flat bearing surface 62, provided for bearing of the leaf 1 against the other leaf 101 of the mitre gate 100. The bearing surface 62 is locally perpendicular to the curve defining a base of the cylinder C2 in a plane perpendicular to the axis Z2. Furthermore, the bearing surface 62 is perpendicular to the middle plane P60 and is centered on the middle plane P60. Furthermore, the bearing surface 62 is generally aligned with the plane P6, on side 26. In other words, the bearing surface 62 is located aligned with the plane P6 and is intersected by the plane P6, since it is perpendicular to the plane P6. Inasmuch as the upright 6 is generally aligned along and around the generatrix Z26, the forces F6 are transmitted directly from the skin plate 2 to the lock wall 5, without causing significant stress concentrations.

During use, owing to the arrangement of the bearing elements 40 and 60, which are aligned with the skin plate 2, the forces F4 and F6 are transmitted from one upright 4 or 6 to the other by passing primarily through the skin plate 2. The bearing surfaces 42 and 62 of the bearing elements 40 and 60 ensure the transmission of the forces F4 and F6 between the lock wall 5 and the uprights 4 and 6 optimally because these surfaces are perpendicular to the forces F4 and F6. Furthermore, since the bearing surfaces of the bearing elements 40 and 60 are centered on the middle plane P40 or P60, the forces F4 and F6 are transmitted optimally to the skin plate 2. Given that the forces F4 and F6 pass little or not at all through the cores 31.0 to 31.11, the junction between the cores 31.0 to 31.11 and the skin plate 2, which, if applicable, is formed using welds, is subjected little or not at all to the fatigue phenomenon, which contributes to improving the fatigue resistance of the leaf 1. As shown in FIGS. 1, 4 and 5, the leaf 1 also includes connecting means 7 for connecting the leaf 1 to an actuating member 8, such as a hydraulic cylinder.

The connecting means 7 are connected to one end of the stiffener 32.21. The hydraulic cylinder that forms the actuating member 8 therefore has one end connected to the connecting means 7 and the other end to the lock wall 5.

The width L100 is equal to approximately 14.3 m. A second ratio that has:

- as numerator: the width L100 of the mitre gate 100, measured between the two uprights 4 and 104 that are the furthest apart, and
- as denominator: the curve radius R2 of the cylinder C2 is equal to approximately 1.1.

The width L100 can be between 6 m and 36 m. The second ratio is between 0.6 and 1.8. In other words, all things also being equal, the smaller the lock angle A100, the smaller the curve radius R2. The lock angle A100 can be between 110° and 160°. Such a second ratio makes it possible to optimize the distribution of forces F4, F6 and equivalent, resulting from the pressure P, between the leaves 1 and 101 and their respective uprights 4, 6, 104 and 106.

Figure 9:
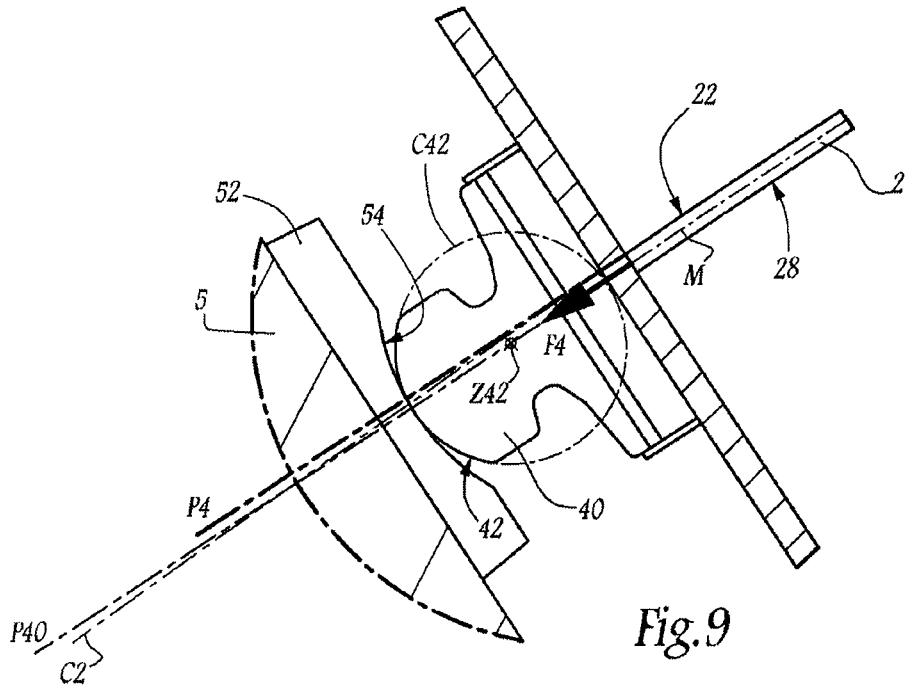
FIG. 9 is a view, similar to FIG. 8, of a lateral end of a leaf according to another embodiment of the invention.

FIG. 9 shows one alternative of the invention in which the bearing element 40 is delimited by a convex bearing surface 42 that has the geometry of a cylinder portion C42. The longitudinal axis Z42 of the cylinder C42 is parallel to the longitudinal axis Z2 of the cylinder C2 that defines the geometry of the skin plate 2, and is comprised in the middle plane P40. In other words, the axis Z42 is aligned with the middle fiber M of the skin plate 2. The bearing surface 42 is locally perpendicular to the middle plane P40 and is centered on the middle plane P40. The bearing surface 42 is also aligned with the plane P4, on the side 24. Furthermore, the bearing surface 42 bears on a pad 52 that is delimited by a concave surface 54 and that is fastened to the lock wall 5. The concave surface 54 has a curve radius slightly larger than the radius of the cylinder C42. The bearing surface 42 bears on the concave surface 54 of the pad 52.

According to alternatives not shown:

several uprights can be juxtaposed along the height of the leaf;

the cylinder that forms the enclosure of the skin plate can have an elliptical base; in the particular case where the two foci of the elliptical base are combined, the base is circular, as for the cylinder C2 of the skin plate 2;

the cylinder forming the enclosure can have a parabolic base;

more generally, the cylinder surrounding the skin plate can have a curved base made up of a juxtaposition of convex and/or concave curvilinear segments;

the means for connecting the actuating member to the leaf can be connected to a part of the leaf other than the stiffener.

A leaf according to the invention makes it possible to transmit the compression forces to each upright of the leaf. The structures and the positions of the components of the leaf according to the invention make it possible to limit the stress concentrations, and therefore to increase the fatigue strength and useful lifetime of a mitre gate according to the invention.

What is claimed is:

1. A leaf for a mitre gate, the leaf comprising:

a skin plate for withstanding a pressure exerted by a liquid; and at least two uprights respectively located on either side of the skin plate, the uprights being secured to the skin plate, the skin plate having an overall shape of a cylinder portion, a longitudinal axis of the cylinder being essentially parallel to the uprights, each upright extending overall according to a generatrix of the cylinder, each upright including at least one bearing element, arranged to project relative to the skin plate, and each bearing element including a bearing surface, for supporting the bearing element against a lock wall or against another leaf of the mitre gate, wherein the bearing surface of each bearing element intersects with a plane that is tangential to an upstream surface of the skin plate, at the side of the skin plate corresponding to said bearing element.

2. The leaf according to claim 1, wherein the bearing surface of at least one bearing element is perpendicular to a middle plane that is parallel to the plane tangential to the upstream surface of the skin plate and that extends a middle fiber of the skin plate, on the bearing element side.

3. The leaf according to claim 2, wherein said bearing surface is centered on the middle plane.

4. The leaf according to claim 1, wherein the bearing surface of at least one bearing element is planar.

5. The leaf according to claim 1, wherein the bearing surface of at least one bearing element is in the shape of a cylinder portion whereof a longitudinal axis of the bearing element is parallel to the longitudinal axis of the cylinder that defines the shape of the skin plate.

6. The leaf according to claim 1, wherein each bearing element is made up of a profile.

7. The leaf according to claim 1, wherein the cylinder has an elliptical base.

8. The leaf according to claim 1, wherein the cylinder has a circular base.

9. The leaf according to claim 1, wherein the cylinder has a parabolic base.

10. The leaf according to claim 8, wherein a first ratio that has:

as numerator, a curve radius of the cylinder, and as denominator, a width of the skin plate, measured between the two uprights, is between 0.6 and 13.

11. The leaf according to claim 1, comprising:

several thin, flat cores, each core having, in a plane transverse to the skin plate, a curve coinciding with the skin plate, each core widening toward the middle thereof and narrowing toward its ends, each core being secured to the skin plate.

12. The leaf according to claim 11, wherein each core is pierced with at least one recess and wherein the leaf comprises at least one generally rectilinear stiffener extending through the recesses respectively belonging to several cores.

13. The leaf according to claim 12, wherein at least one stiffener is tubular.

14. The leaf according to claim 12, wherein the or each stiffener is fastened to several cores using welds made in a plane perpendicular to an axis of the cylinder.

15. The leaf according to claim 12, wherein it also comprises a fastener for fastening a member for actuating the leaf, the fastener being connected to one end of a stiffener.

16. A mitre gate comprising two leaves, wherein each leaf is according to claim 8 and wherein a second ratio that has:

as numerator: a width of the mitre gate, measured between the two uprights that are the furthest apart, and as denominator: a curve radius of the cylinder is between 0.6 and 1.8.

* * * * *